United States Patent [19]

Åkhagen et al.

[11] Patent Number: 4,543,885

[45] Date of Patent: Oct. 1, 1985

[54] INCREMENT CHARGE FOR A FINNED PROJECTILE

[75] Inventors: Rune Åkhagen, Eskilstuna; Arthur Jansson, Åkers Styckebruk, both of Sweden

[73] Assignee: Forenade Fabriksverken, Eskilstuna, Sweden

[21] Appl. No.: 474,030

[22] Filed: Mar. 10, 1983

[30] Foreign Application Priority Data

Apr. 1, 1982 [SE] Sweden ..... 8202085

[51] Int. Cl.[4] ..... F42B 13/26

[52] U.S. Cl. ..... 102/373; 102/288

[58] Field of Search ..... 102/372, 373, 288, 289, 102/291

[56] References Cited

U.S. PATENT DOCUMENTS

| | | | |
|---|---|---|---|
| 1,883,758 | 10/1932 | Brandt | 102/373 |
| 2,069,794 | 2/1937 | Woodberry | 102/373 |
| 2,210,959 | 8/1940 | Storm | 102/373 |
| 2,620,732 | 12/1952 | Hickman | 102/373 |
| 2,721,518 | 10/1955 | Hickman | 102/373 |
| 2,918,005 | 12/1959 | Schecter et al. | 102/373 |
| 3,017,836 | 1/1962 | Guay | 102/378 |
| 3,638,571 | 2/1972 | Gawlick et al. | 102/373 |

FOREIGN PATENT DOCUMENTS

| | | | |
|---|---|---|---|
| 74385 | 12/1944 | Czechoslovakia | 102/373 |
| 496792 | 12/1938 | United Kingdom | 102/373 |

*Primary Examiner*—Charles T. Jordan
*Assistant Examiner*—Ted L. Parr
*Attorney, Agent, or Firm*—Fleit, Jacobson, Cohn & Price

[57] ABSTRACT

Increment charge for a finned projectile designed to surround a cartridge tube on the projectile and to be ignited by the ignition gases from a propellant and ignition cartridge included in the cartridge tube. The surface of the increment charge which faces the cartridge tube is enlarged in that it is provided with a number of recesses which provide access for the said ignition gases. The increment charge consists appropriately of a number of powder discs of horseshoe-shape, provided with holes, the inner edge of which is asymmetric relative to the aperture of the horeshoe-shape. Each alternate disc is inverted so that the shape of the hole edge is inverted in mirror fashion for each alternate disc.

1 Claim, 4 Drawing Figures

INCREMENT CHARGE FOR A FINNED PROJECTILE

The present invention relates to an increment charge for a finned projectile designed to surround a cartridge tube in the projectile and be ignited by the ignition gases from a propellant and ignition cartridge included in the cartridge tube.

A customary embodiment of increment charges for finned projectiles consists of a crushed powder which is punched into shapes similar to a horeshoe. These charges contain a number of relatively thin such discs, normally grouped together in a textile covering. The internal horseshoe-shape is substantially circular (an open circle) and somewhat larger than the cartridge tube. A selected number of such increment charges, together with a propellant and ignition cartridge arranged in the cartridge tube, comprise the total charge for ejecting the projectile from a barrel. The cartridge tube is provided with holes through which the combustion gases from the said cartridge flow outwards to the increment charges in order to ignite these.

It is important that the increment charge powder discs should be effectively ignited over as large a portion of the surface of the individual powder discs as possible. As a result of the way in which the increment charges are located in relation to the ignition unit (the propellant and ignition cartridge), gas which flows outwards through the system of holes in the cartridge tube will primarily encounter the relatively compacted inner edge surface of the powder pack and will then subsequently spread outwards to the "major surfaces" of the discs.

A prerequisite for combustion of the powder to take place uniformly from one shot to the next, and thus ensure only slight variations in velocity, is that the "major surfaces" of the powder discs be rapidly and effectively ignited, because it is a prerequisite that such combustion should take place so that the entire powder charge can be burnt at the correct velocity. This ignition of the "major surfaces" presupposes that the ignition gases can easily penetrate in between the individual discs.

The object of the present invention is to provide an increment charge which, thanks to extremely simple and cheap shaping of the increment charge, provides particularly good access facilities for the ignition gases flowing outwards from the propellant and ignition cartridge.

The invention will be described in greater detail by reference to the appended drawings.

Figure 1:
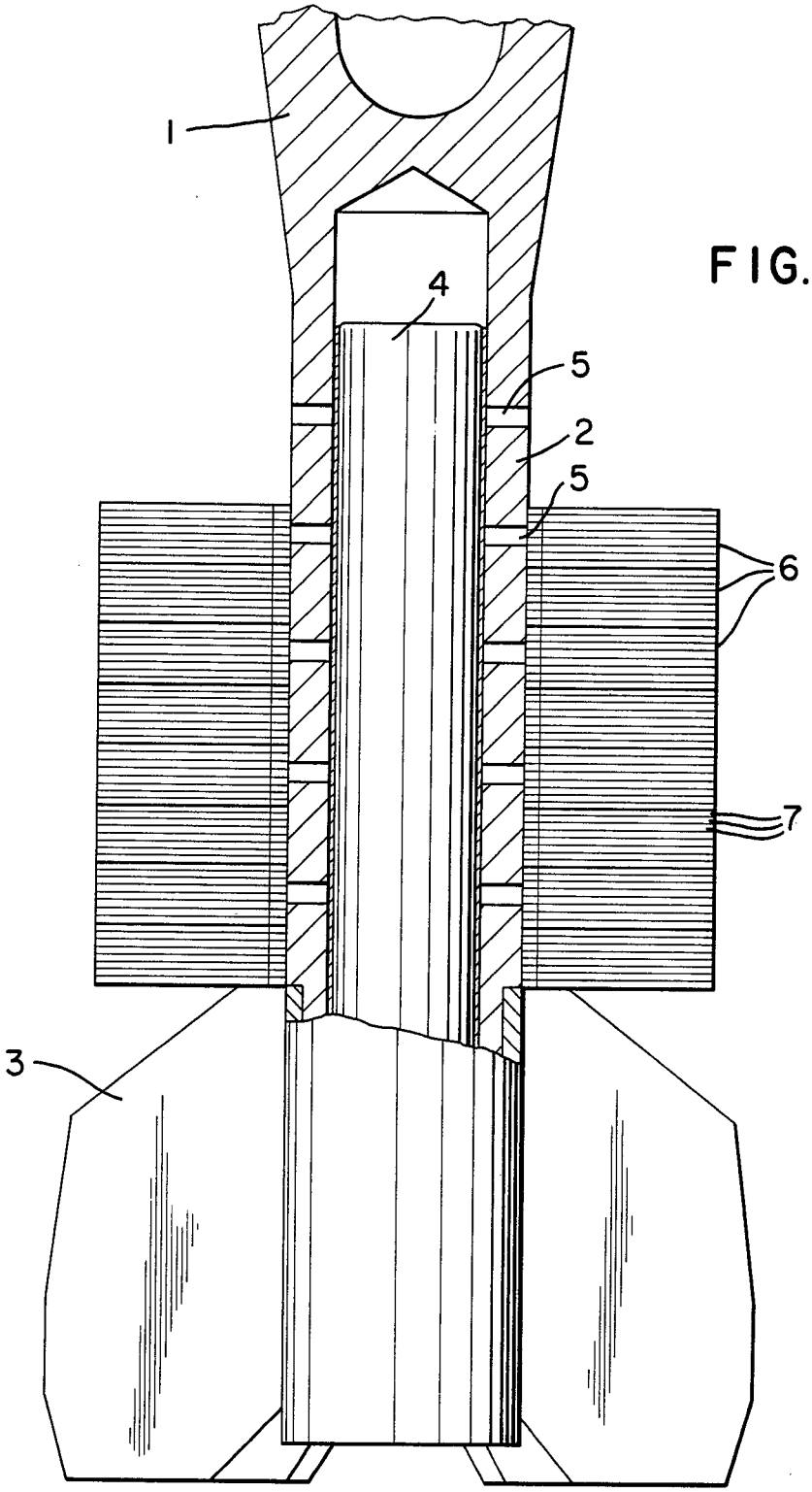

FIG. 1 provides a side view, partly in longitudinal section, of the rear portion of a conventional finned projectile provided with a number of increment charges in accordance with the invention.

Figure 2:
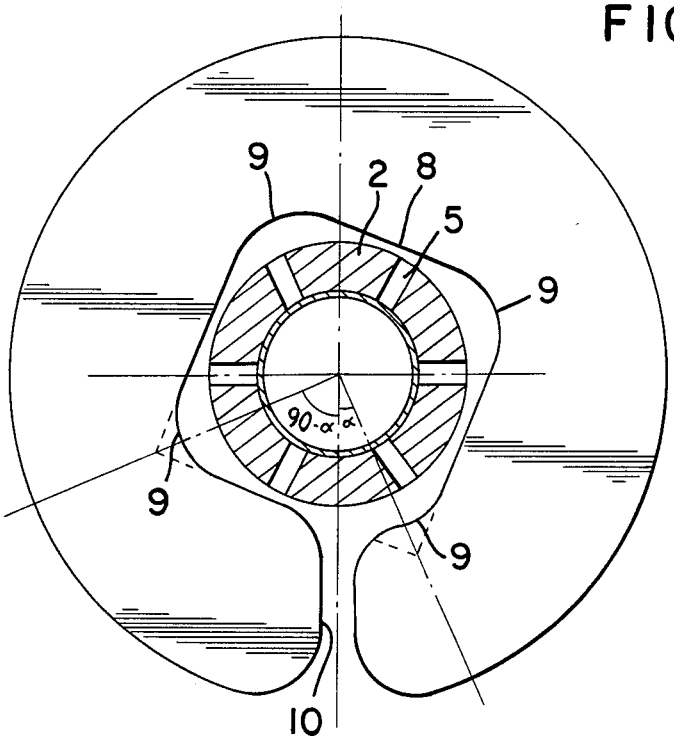

FIG. 2 provides a plan view of the powder disc which forms part of an increment charge in accordance with an invention.

Figure 3:
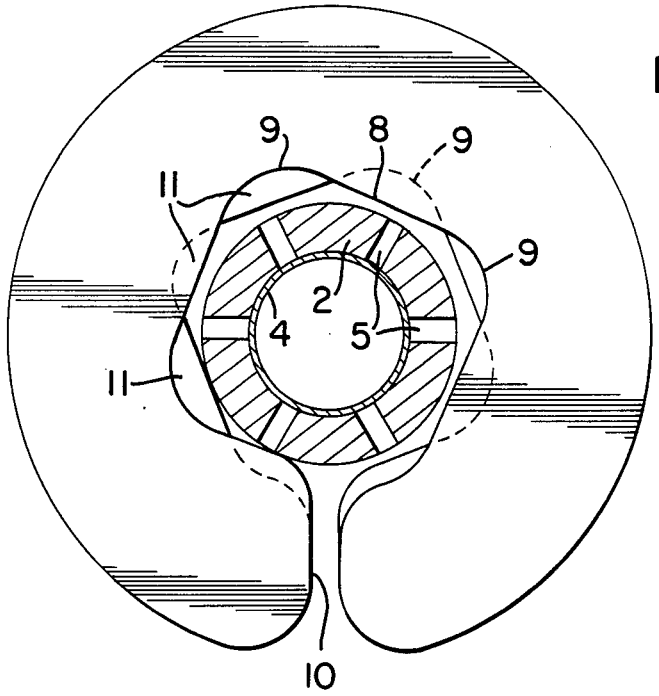
Figure 4:
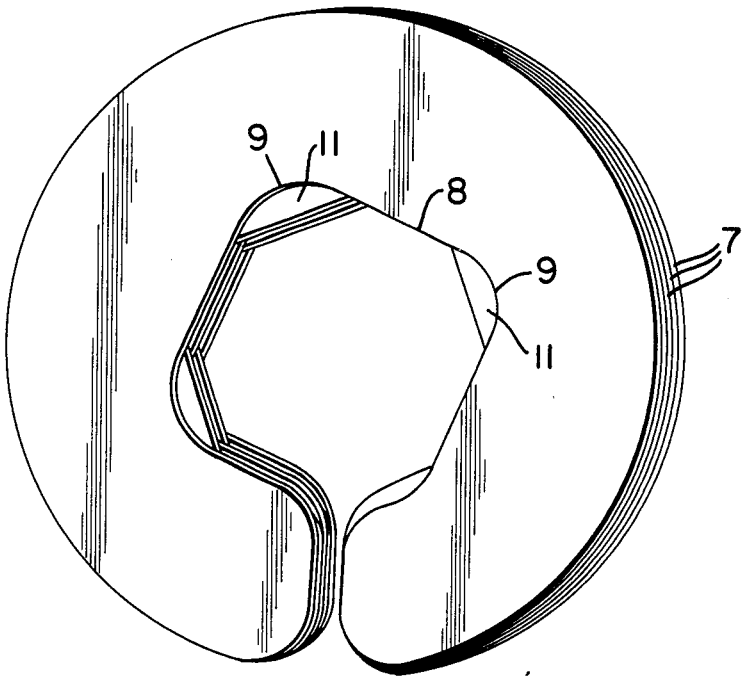

FIGS. 3–4 show schematically in plan view and in perspective respectively an arrangement of several powder discs in accordance with FIG. 2.

FIG. 1 illustrates the rear portion of a conventional finned projectile 1 with a cartridge tube 2. The cartridge tube 2 is provided in a conventional manner with a guidance mechanism 3, which is shown only partially, and includes a conventional propellant and ignition cartridge 4 which is shown only schematically. The wall of the cartridge tube 2 has a number of apertures 5 so as to permit the outward flow of the ignition gases from the cartridge 4 to a number (eight in the example shown) of increment charges 6 in accordance with the invention.

Each increment charge 6 consists of a number (in the example shown here eight) of horseshoe-shaped powder discs 7, having their "major surfaces" placed against each other, provided with respective central holes, and preferably enclosed in a conventional textile covering and pushed around the cartridge tube 2.

A preferred embodiment of the individual powder discs 7 is illustrated in FIGS. 2–4. So as to provide a more detailed explanation of the mutual arrangement of the powder discs 7 in the increment charges 6, FIG. 2 illustrates a single such disc 7 pushed around the cartridge tube 2, whilst FIG. 3 illustrates the mutual arrangement of two such discs and FIG. 4 illustrates a perspective view of a pack of five such discs 7.

In the embodiment illustrated in FIGS. 2–4 the inner edge of each of the powder discs 7 has the shape of a centrally-located square 8 with radiussed corners 9, where the square 8 has been rotated through an angle $\alpha$ of appropriately about 30° relative to the "horseshoe aperture" 10 of the disc. As a result of the inner edge of the disc 7 being given such an asymmetrical shape relative to the horseshoe aperture 10, when alternate discs are turned, a pack is obtained as shown in FIGS. 3 and 4 where a number of recesses 11 are obtained in the pack of discs because the corner edge portions 9 in each disc are located at a greater distance from the cartridge tube 2 than the nearest edge portions of adjacent discs, with alternate discs inverted or rotated as shown in FIGS. 3 and 4 so that the form or shape of the hole edge is inverted in mirror fashion for each second or alternate discs.

Those portions of the major surfaces of the discs 7 which, viewed in the longitudinal direction of the tail tube, confine the recesses 11 are exposed to the ignition gases which flow outwards from the cartridge 4. Hence right from the outset the pack of powder discs exhibits a larger combustion surface and the gas can by this means immediately open up the individual powder discs 7.

During comparative firing using charges which in all other respects were uniform and where the sole difference was the design of the inner shape of the horseshoe, clear reductions in velocity scatter were obtained with the embodiment illustrated in FIGS. 2–4. Similarly a reduced pressure rise was encountered, particularly with cold-brittle increment charges, because of smoother and more efficient ignition of the charge. This was because the increment charges were forced apart, as a result of the gas entering between the individual powder discs, so that the gas mass can flow outwards towards the periphery of the barrel without encountering the same degree of resistance from the inner edge surfaces of the increment charges and without crushing the parts of the powder discs to the same extent.

The same access surface for the ignition gases can naturally also be provided by ramming the powder discs 7 in two different inner edge shapes which are placed against each other (not shown).

In accordance with a further embodiment, not shown, the inner shape of all discs 7 is circular, but with a smaller diameter for each second or for each second and third disc.

We claim:

1. An increment charge for a finned projectile designed to surround a cartridge tube in the projectile and to be ignited by the ignition gases from a propellant and ignition cartridge included in the cartridge tube, which comprises:

a surface on the increment charge which faces towards the cartridge tube and which is enlarged such that it exhibits a number of recesses which provide access for said ignition gases to the increment charge; and a number of powder discs provided with holes, the discs having major surfaces facing each other and having hole edges which surround the cartridge tube;

wherein said recesses are obtained because at least one hole edge section on each powder disc is located at a greater distance from the cartridge tube than the nearest hole edge portions on adjacent powder discs;

wherein the powder discs each have a horseshoe-shape, wherein the inner edge of the horseshoe-shaped which corresponds to the hole edge of the powder disc is asymmetric relative to an aperture of the horseshoe-shape, and wherein each alternate disc is turned so that the form of the hole edge is inverted in mirror fashion for each second disc.

* * * * *